US008047514B2

(12) United States Patent
Wolf et al.

(10) Patent No.: US 8,047,514 B2
(45) Date of Patent: Nov. 1, 2011

(54) SPRING ARRANGEMENT FOR A VEHICLE

(75) Inventors: Andreas Wolf, Winterthur (CH); Michael Wusching, Wilthen (DE); Mario Bonk, Steinigtwolmsdorf (DE)

(73) Assignee: Bombardier Transportation GmbH, Berlin (DE)

( * ) Notice: Subject to any disclaimer, the term of this patent is extended or adjusted under 35 U.S.C. 154(b) by 684 days.

(21) Appl. No.: 12/132,775

(22) Filed: Jun. 4, 2008

(65) Prior Publication Data

US 2009/0008843 A1 Jan. 8, 2009

(30) Foreign Application Priority Data

Jun. 5, 2007 (DE) ..... 102007026472

(51) Int. Cl.
*F16F 3/08* (2006.01)

(52) U.S. Cl. ..... 267/290; 267/152

(58) Field of Classification Search ..... 267/152, 267/34, 3, 289, 290; 105/198.1, 198.7
See application file for complete search history.

(56) References Cited

U.S. PATENT DOCUMENTS

| | | | | |
|---|---|---|---|---|
| 1,825,093 | A | | 9/1931 | Sansburn |
| 2,562,573 | A | * | 7/1951 | Piron ..... 105/198.7 |
| 2,573,108 | A | | 10/1951 | Piron |
| 3,223,400 | A | * | 12/1965 | Deister, Jr. ..... 267/152 |
| 3,343,830 | A | * | 9/1967 | Dean et al. ..... 267/34 |
| 3,491,702 | A | | 1/1970 | Dean |
| 4,108,080 | A | | 8/1978 | Garner et al. |
| 4,294,175 | A | | 10/1981 | Harsy |
| 4,723,491 | A | | 2/1988 | von Madeyski et al. |

FOREIGN PATENT DOCUMENTS

| | | |
|---|---|---|
| EP | 0229930 B1 | 7/1987 |
| FR | 1576829 | 8/1969 |

* cited by examiner

*Primary Examiner* — Melanie Torres Williams
(74) *Attorney, Agent, or Firm* — The Webb Law Firm

(57) ABSTRACT

A spring arrangement for a vehicle, in particular a rail vehicle, with a first spring device and a second spring device, wherein the first spring device and the second spring device are mechanically arranged in series, and are designed to support a component of the vehicle on a further component of the vehicle in a support direction, the first spring device has a first transverse rigidity in a transverse direction running transverse to the support direction, the second spring device has a second rigidity in the transverse direction which is smaller than the first transverse rigidity. The first spring device and the second spring device are arranged nested in the support direction.

17 Claims, 2 Drawing Sheets

SPRING ARRANGEMENT FOR A VEHICLE

Figure 1:
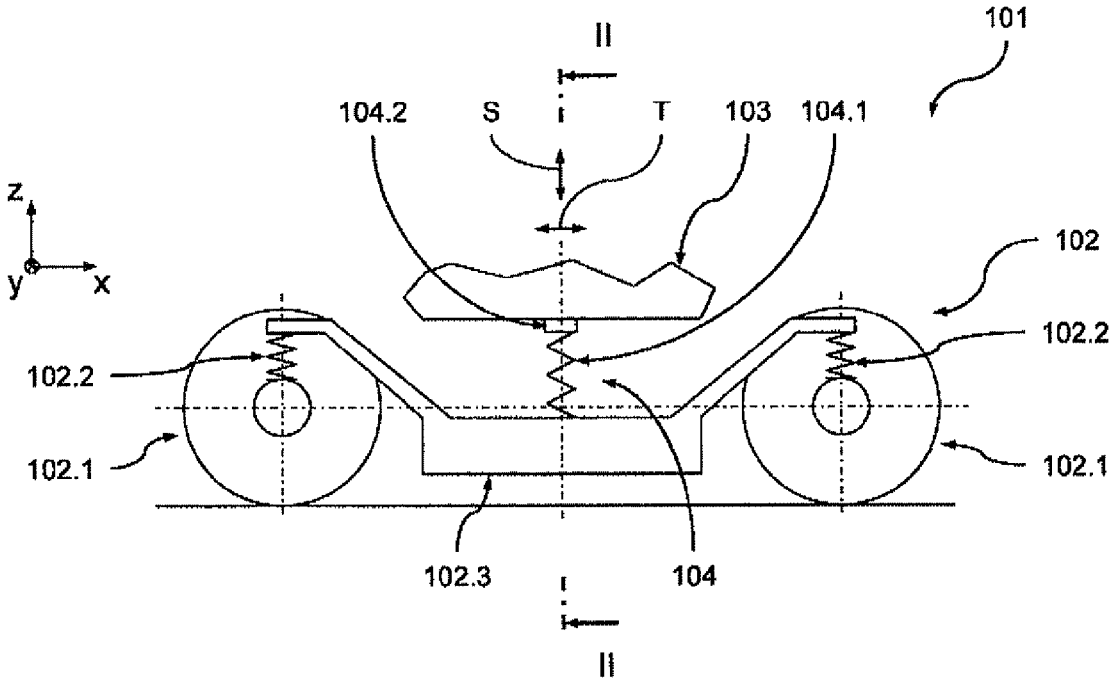

The present invention relates to a spring arrangement for a vehicle, in particular a rail vehicle, with a first spring device and a second spring device. The first spring device and the second spring device are mechanically arranged in series and are designed to support a component of the vehicle on a further component of the vehicle in a support direction. The first spring device comprises a transverse rigidity in a transverse direction running transverse to the support direction, while the second spring device comprises a second transverse rigidity in the transverse direction, which is smaller than the first transverse rigidity. The invention further relates to a vehicle, in particular a rail vehicle, with such a spring arrangement according to the invention.

With vehicles, in particular rail vehicles, the body accommodating the passengers is as a rule supported by at least one spring step on the running gear in order to achieve acceptable travel characteristics and at the same time to take account of the comfort of the passengers. With rail vehicles, besides single-step spring arrangements, running gear arrangements in the form of bogies with a two-step spring element are frequently used. With these types of running gear, in the first instance a bogie frame is supported by what is referred to as a primary spring step on the wheel units, while the body is then supported by what is referred to as a secondary spring step on the bogie frame.

Both with the single-step as well as the two-step spring arrangement, as a rule a first spring device is used, in most cases one or more helical springs mechanically arranged in parallel, which provides adequate spring travel between the vehicle components concerned. In order to increase travel comfort for the passengers in the vehicle, a second spring device is frequently provided, mechanically connected in series to the first spring device, which comprises a lesser transverse rigidity than the first spring device, in order to allow transverse movements of the two vehicle components. These second spring devices are, as a rule, rubber spring elements, such as are known, for example from EP 0 229 930 B1. With this known spring arrangement, the helical springs of the secondary spring stage are supported by rubber spring elements of approximately the same diameter on the bogie frame. As well as lesser transverse rigidity, the rubber spring elements also have the advantage that they have an oscillation damping effect, such that a reduction in the induction of surface-borne noise into the body is achieved.

Particularly in the sector of light railway vehicles, which are wholly or partially designed as low-floor vehicles, however, the problem arises that in the support direction (as a rule in the height direction of the vehicle) there is regularly only very little structural space available for the installation of the spring step. For the two spring devices arranged in series, a compromise must therefore be found between the support characteristics required (in particular the height and longitudinal rigidity of the springs in the support direction) and the comfort characteristics (in particular low transverse rigidity), which in most cases is at the expense of travel comfort. Thus, as a rule, with such vehicles only two spring devices of low height can be used, which, despite their lower transverse rigidity (in relation to the helical springs of the first spring direction), only offer a comparatively small gain with regard to travel comfort.

The present invention is based on the object of providing a spring arrangement or a vehicle respectively of the type referred to in the preamble which does not comprise the disadvantages referred to heretofore, or at least only to a clearly lesser degree, and, in particular with low structural space requirement, makes improved comfort characteristics of the spring arrangement possible.

The present invention solves this object, taking a spring arrangement in accordance with the preamble to Claim 1 as a starting point, by means of the features indicated in the characterisation part of Claim 1.

The present invention is based on the technical teaching that, with a generic spring arrangement, despite a very compact design, in particular a low structural length in the support direction, an improvement in the comfort characteristics of the spring is achieved if the first spring device and the second spring device arranged mechanically in series to it, are arranged nested in the support direction. Due to the nested arrangement of the two spring devices it is possible, despite the mechanically serial arrangement, to achieve a very compact arrangement with a low overall height in the support direction. The nested arrangement makes it possible, in particular, for the height (dimension in the support direction) of the second spring device, softer in the transverse direction (within the limits imposed by the overall structural height of the spring arrangement) to be varied almost at will, and, among other things, in this way to adapt the transverse rigidity in accordance with the desired or required comfort characteristics of the spring arrangement.

According to one aspect, the present invention therefore relates to a spring arrangement for a vehicle, in particular a rail vehicle, with a first spring device and a second spring device, wherein the first spring device and the second spring device are mechanically arranged in series and are designed to support a component of the vehicle on a further component of the vehicle in a support direction. The first spring device comprises a first transverse rigidity in a transverse direction running transverse to the support direction, while the second spring device comprises a second transverse rigidity in the transverse direction which is smaller than the first transverse rigidity. The first spring device and the second spring device are arranged nested in the support direction.

The connection between the first spring device and the second spring device can in principle be effected in any suitable manner. Provision may therefore be made, for example, for the first and second spring devices to be designed in such a way that the first and second spring devices can be placed directly on top of one another. In the case of one traditional arrangement in particular, in which helical springs are used for the first spring device and rubber spring elements for the second spring device, provision may be made for the second spring device itself to have a corresponding design which makes the connection surfaces for the first spring device directly available.

With particularly easily produced variants of the spring arrangement according to the invention, provision is made for the first spring device and the second spring device to be connected to one another by at least one connecting element designed as a separate component. The two spring devices can then be simply designed in a conventional manner, such that, as appropriate, standard components can be used.

The connection element can in principle be designed in any manner (single-part or multi-part), in order to guarantee the nesting of the two spring devices. It is merely required that the connection element provides connection surfaces for the two spring devices, in each case arranged in relation to each other, for example offset to one another in the support direction, in such a way that the penetration of the cover surface of the one spring device into the cover surface of the other spring device is guaranteed.

The connection between the two spring devices and the connection element can likewise be in principle designed in any suitable manner. Thus, for example, for at least one of the spring devices, a connection surface can be provided pointing in the transverse direction. For example, if a rubber spring element is used as the second spring device, a cylindrical connection surface (with the cylinder axis pointing in the support direction) can be provided, to which the rubber spring element is secured, such as by being vulcanised to it. Because of the particularly simple design, however, preferably connection surfaces are provided which in each case point in a direction parallel to the support direction, on which the individual spring device can be easily supported.

With advantageous variants of the spring arrangement according to the invention, the connection element is designed in pot shape, with an inner floor section and an outer edge section. The floor section comprises a floor support surface, and the edge section an edge support surface. The floor support surface and the edge support surface are spaced apart from one another in the support direction by one support surface interval and point in opposite directions running parallel to the support direction. The first spring device is supported on the floor support surface and the second spring device on the edge support surface. As an alternative, the first spring device is supported on the edge support surface and the second spring device is supported on the floor support surface. By way of such an arrangement it is possible in a simple manner for the nesting of the two spring devices to be achieved. The pot-shaped design of the connection element in this situation additionally guarantees high stability of the connection element, such that this can be designed with comparatively low wall thicknesses, and therefore allows for a particularly compact arrangement.

Preferably, the first spring device comprises in the support direction a first end and a second end, while the connection element comprises a first support surface for the second end of the first spring device and a second support surface for the second spring device. The first support surface and the second support surface in the support direction are spaced apart by one support surface interval and point in opposite directions running parallel to the support direction, wherein the first support surface in the support direction is further away from the first end of the first spring device than the second support surface. As a result of this offset arrangement of both support surfaces along the support direction, it is possible for the nesting of the two spring devices to be realised in a simple manner.

As already indicated above, the height of the second spring device, and therefore (with a predetermined overall height of the spring arrangement), in the final analysis, the distance between the support surfaces, and the mutual penetration resulting from this of the two spring devices, can be selected arbitrarily depending on the comfort characteristics desired, within the limits imposed by the overall height. Preferably, a certain minimum dimension of nesting or penetration of the two spring devices is selected in order to achieve an adequate height of the second spring device and therefore correspondingly high comfort characteristics of the springing. Preferably, the support surface interval therefore amounts to at least 25%, preferably at least 50%, and more preferably at least 75%, of the dimension of the second spring device in the support direction, such that the cover surfaces of the two spring devices accordingly penetrate far into one another.

The transverse deflection of the second spring device can only be delimited by the elastic return force deriving from the deformation of the second spring device. Preferably, however, a separate delimitation of the transverse deflection is provided, in order to attain a defined delimitation of the transverse deflection and/or a predeterminable characteristic of the transverse rigidity and the transverse deflection deriving from this. Preferably, therefore, at least one stop device is provided which is designed to delimit the transverse deflection of at least one part of the second spring device in relation to the first spring device in the transverse direction.

In this situation, provision can therefore be made in particular for the stop device to delimit the transverse deflection of only a part of the second spring device, while a further transverse deflection is possible over the other part (not delimited in its transverse deflection by the stop device). This allows, in an advantageous manner, a deflection-dependent (e.g. progressive) characteristic of the transverse rigidity of the second spring device to be achieved. In this situation, in principle as many steps of the stop surfaces can be provided as desired, at consistent or varying intervals, in order to attain almost any desired characteristic of the transverse rigidity of the second spring device. In addition to this, or as an alternative, it is of course also possible for the transverse rigidity of the individual sections of the second spring device to be varied accordingly.

Provision can therefore be made, for example, for the entire second spring device firstly to undergo a transverse deflection until the transverse deflection of the lowest part is delimited by a stop. If further transverse deflection takes place, it is then only the sections located above the lowest section which are deformed, until a further stop also delimits the transverse deflection of a middle section of the second spring device. If further transverse deflection takes place, it is then only the topmost section located above the middle section which is deformed, until a further stop finally delimits the transverse deflection of this also, and so finally delimits the transverse deflection of the second spring device. As each stop is reached, the transverse rigidity of the second spring device increases in the process.

The stop device can in principle be designed in any suitable manner. In particular, it can be created by separate components. Preferably, however, provision can be made for at least one part of the stop device to be formed by the second spring device, in order for a compact arrangement with few components to be created. Preferably, provision is accordingly made for the first spring device and the second spring device to be connected to each other by at least one connection element, and for the stop device to have at least a first stop surface and a second stop surface provided to interact with the first stop surface, wherein the first stop surface is formed at the second spring device and the second stop surface is formed at the connection element.

Preferably, in this situation the second spring device is supported in the support direction with its first end on the connection element, and the first stop surface in the support direction is spaced at a distance of at least 20%, preferably at least 35%, and more preferably at least 50% of the dimension of the second spring device in the support direction from the first end of the second spring device. This allows a particularly favourable progression of the characteristics of the transverse rigidity to be achieved.

The first spring device can in principle be designed in any suitable manner. In particular, any conventional spring elements can be used for the first spring device. Particularly simple, robust, and compact arrangements can be achieved if the first spring device comprises at least one spring element designed in the manner of a helical spring.

Preferably, the first spring device and the second spring device are connected to one another by at least one connection element, and the connection element takes on, in a conventional manner, at least a part of a transverse guide for the spring element, such that, by way of this function integration (connection of the two spring devices and transverse guidance of the spring element), a particularly compact arrangement is arrived at.

The second spring element, too, can in principle be designed in any suitable manner. In particular, here also any conventional spring elements can be used for the second spring device. With particularly favourable variants of the spring arrangement according to the invention, the second spring device comprises at least one synthetic material spring element, in particular a rubber spring element. In the final analysis, this allows particularly favourable characteristics of the transverse rigidity of the spring arrangement to be achieved with conventional components. Preferably, the second spring device is designed in the form of a leaf spring element with at least two synthetic material layers and a separation layer arranged between the two synthetic material layers, in particular a metal layer. This allows particularly simple and robust designs to be achieved. In particular, as already indicated above, it is possible for provision to be made for the individual layers to have different transverse rigidity, in order to attain a desired progressive characteristic of the transverse rigidity.

With variants of the spring arrangement according to the invention which are advantageous because of their simple design, in this case at least one stop device is provided, which is designed to delimit the transverse deflection of at least a part of the second spring device in relation to the first spring device in the transverse direction and the separation layer defines at least one stop surface of the stop device.

The relationship between the first transverse rigidity and the second transverse rigidity can in principle be selected as desired. In particular, it can be selected depending on the dimensions of the two spring devices and the comfort characteristics to be achieved. Preferably, provision is made for the second transverse rigidity to amount to a maximum of 50%, preferably a maximum of 35%, and more preferably a maximum of 20% of the first transverse rigidity, in order (in particular with second spring devices of low height) to achieve particularly favourable comfort characteristics.

As already indicated, the nesting of the two spring devices can be designed to be as strong as desired. Preferably, however, provision is made for the first spring device to define a first cover surface, the second spring device to define a second cover surface, and the first spring device and the second spring device to be arranged nested in such a way that the first cover surface and the second cover surface in the support direction penetrate into one another by at least 20%, preferably at least 35%, and more preferably at least 50%, of the dimension of the second spring device in the support direction.

The present invention further relates to a vehicle, in particular a rail vehicle, with a first component and a second component which is supported on the first component by means of a spring arrangement according to the invention. With this vehicle the variants and advantages described above can be realised in the same degree, such that in this respect reference is made solely to the remarks made above.

The spring arrangement according to the invention can in this situation, inter alia, be used both for a single-step spring arrangement as well as with a two-step or multi-step spring arrangement for the primary springing of the vehicle.

Particularly advantageous, however, is its use in connection with the secondary springing of a multi-step sprung vehicle, since realising the comfort characteristics is only advantageous from the point of view of travel dynamics directly at the transition to the body accommodating the passengers. Preferably, the first component is therefore a body of the vehicle and the second component is at least a part of a running gear of the vehicle, in particular a running gear frame of a running gear of the vehicle.

The invention can be put to use in connection with any vehicles. Its use is particularly advantageous, however, in connection with light railway vehicles. This applies in particular if these are designed at least in part in low-floor format.

Figure 2:
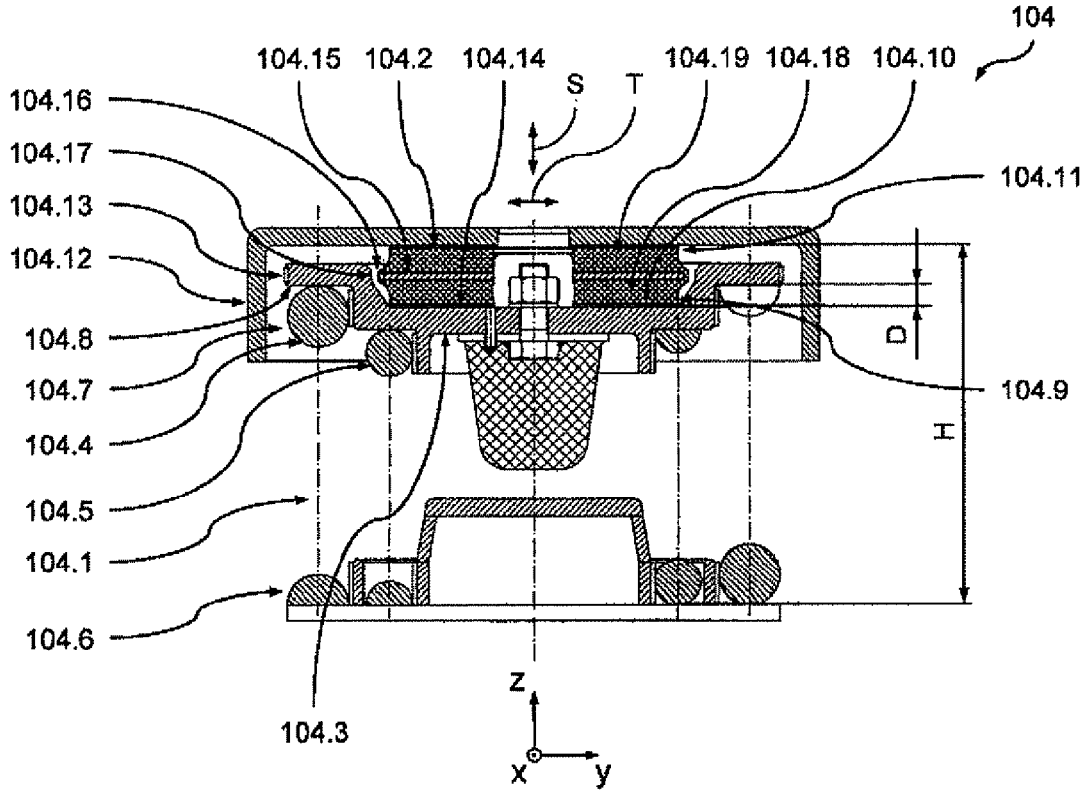
Figure 3:
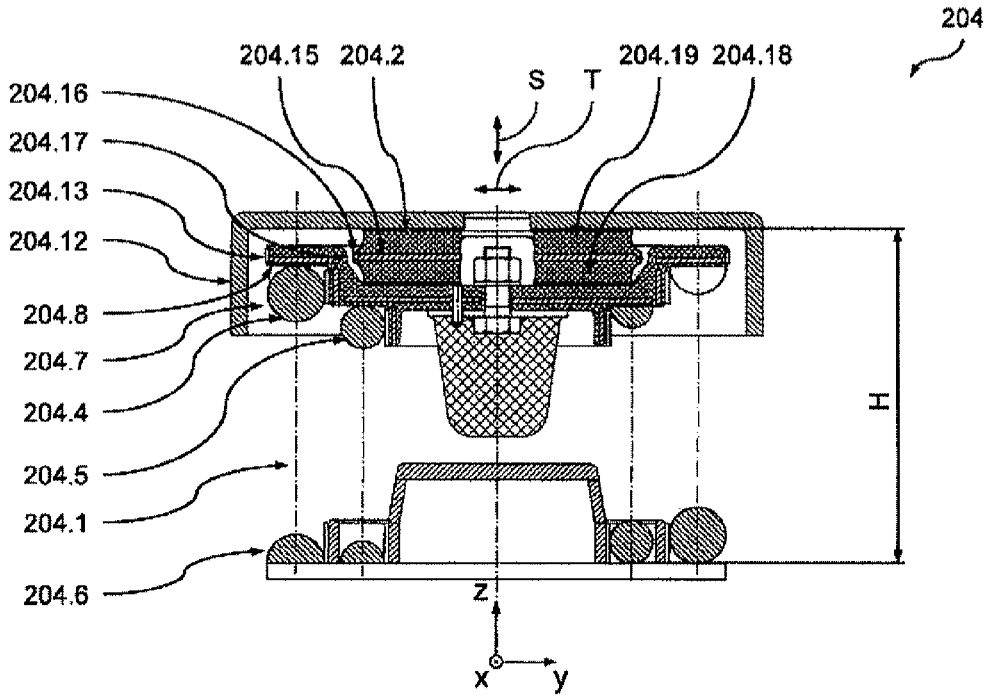
Figure 4:
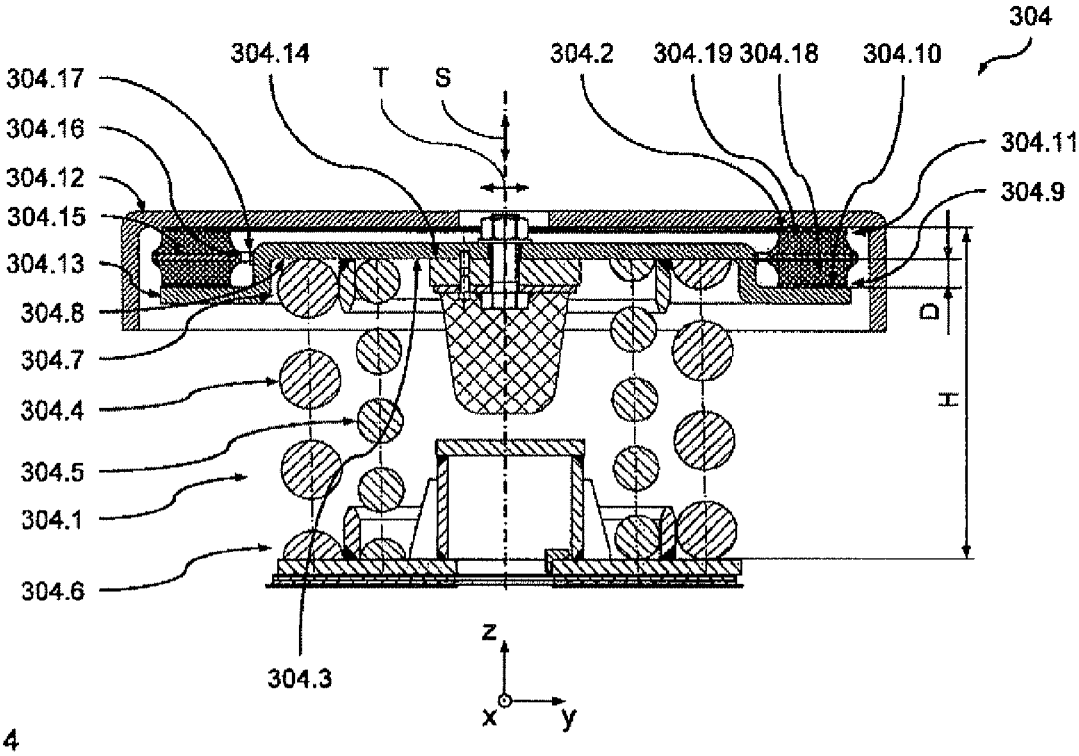

Further preferred embodiments of the invention result from the sub-claims and the description which follows of preferred embodiments, which refer to the appended drawings. These show:

FIG. 1 A diagrammatical side view of a preferred embodiment of the rail vehicle according to the invention;

FIG. 2 A diagrammatical section through a preferred embodiment of the spring arrangement according to the invention along the line II-II from FIG. 1;

FIG. 3 A diagrammatical section through a further preferred embodiment of the spring arrangement according to the invention;

FIG. 4 A diagrammatical section through a further preferred embodiment of the spring arrangement according to the invention.

FIRST EMBODIMENT EXAMPLE

A preferred embodiment of the vehicle according to the invention is described hereinafter by reference to FIGS. 1 and 2. FIGS. 1 and 2 show diagrammatical representations of a part of a vehicle according to the invention, in the form of a light railway vehicle 101 in low-floor design format. The vehicle 101 comprises as a first vehicle component a running gear 102, on which is supported a body 103 as the second vehicle component.

The vehicle 101 comprises a longitudinal axis, a transverse axis, and a height axis, which in the position of rest of the vehicle 101 on a straight horizontal track, represented in FIGS. 1 and 2, run parallel to the co-ordinate axes x, y, z represented.

The running gear 102 is designed in the manner of a bogie. It comprises two wheel sets 102.1, on the wheel bearings of which a bogie frame 102.3 is supported in each case by means of a primary spring step 102.2 in a support direction S (which in the position of rest shown runs parallel to the z-axis). The body 103 is in turn supported by means of the spring arrangement according to the invention represented in greater detail in FIG. 2 in the form of a secondary spring step 104 in the support direction S on the bogie 102.

As can be seen in detail from FIG. 2, the secondary spring step 104 comprises a first spring device 104.1 supported on the bogie 103, as well as a second spring device 104.2 arranged mechanically in series thereto, on which the body 103 is supported. The second spring device 104.2 is connected to the first spring device 104.1 by means of a connection element 104.3.

The first spring device 104.1 comprises a first helical spring 104.4 and a second helical spring 104.5 arranged mechanically parallel and concentric to the first. The second spring device 104.2 is designed in the form of a ring-shaped leaf spring made of synthetic material (in this case rubber) and metal, in a manner already long known, which has a smaller outer diameter than the first spring device 104.1 and is arranged concentrically to the first spring device 104.1.

The first spring device 104.1 comprises in a transverse direction T (in the xy-plane in the position of rest shown), running transversely (in the present example perpendicular) to the support direction S, a first transverse rigidity, which is greater than the second transverse rigidity which the rubber leaf spring 104.2 comprises in this transverse direction T. In the present example, the second transverse rigidity of the rubber leaf spring 104.2 is some 50% of the first transverse rigidity of the first spring device 104.1. It is understood, however, that with other variants of the invention another proportion can be selected between the first transverse rigidity and the second transverse rigidity.

The higher, first helical spring 104.4 of the first spring device 104.1 is supported at its first end 104.6 on the bogie 102 (not represented in FIG. 2), while its second end 104.7 is supported against a first support surface 104.8 of the connection element 104.3. The rubber leaf spring 104.2 is in turn supported with its first end 104.9 on a second support surface 104.10 of the connection element 104.3, while the second end 104.11 of the rubber leaf spring 104.2 is supported by a contact element 104.12 secured to it on the body 103 (not represented in FIG. 2).

The connection element 104.3, in addition to providing the connection between the first spring device 104.1 and the second spring device 104.2, also takes over the guidance of the two helical springs 104.4, 104.5 of the first spring device 104.1.

The connection element 104.3 is designed in pot shape, wherein the pot is open towards the body 103. The first support surface 104.8 is designed as an edge support surface at an outer edge section 104.13 of the connection element 104.3, while the second support surface 104.10 is designed as a floor support surface on an inner floor section 104.14 of the connection element 104.3.

The first support surface 104.8 and the second support surface 104.10 point in opposed directions running parallel to the support direction S and are spaced apart in the support direction S at an interval of one support surface D from one another, such that the first support surface 104.8 in the support direction S is further away from the first end 104.6 of the first spring device 104.1 than the second support surface 104.10. Accordingly, the first spring device 104.1 and the second spring device 104.2 are arranged nested into one another in such a way that the first cover surface of the first spring device 104.1, defined by the first helical spring 104.4, and the second cover surface of the second spring device 104.2, defined by the rubber leaf spring 104.2, penetrate through or into is one another in the support direction S.

The support surface interval D in this situation amounts to some 40% of the height (dimension in the support direction S) of the second spring device 104.2, such that its second cover surface accordingly projects by 40% into the first cover surface of the first spring device 104.1. This nested arrangement of the first and second spring device 104.1, 104.2, arranged in mechanical series, has the advantage that, with a given overall height H of the springing components of the secondary spring step 104, despite a considerable first height H1 of the first spring device 104.1, a comparably great second height H2 of the second spring device 104.2 can be realised. The sum of the first height H1 and the second height H2 in this situation exceeds the overall height H (H1+H2>H).

This nesting arrangement according to the invention make it possible for the second height H2 of the second spring device to be adapted in such a way that the secondary spring step 104 comprises a transverse rigidity such as is required for specific predeterminable comfort requirements with regard to the introduction of acceleration forces in the transverse direction T into the body 103.

It is understood that the two spring devices in other variants of the invention can also penetrate into one another by an amount deviating from this. In particular, the second spring device can penetrate into the first spring device, within the limits specified by the overall height H, and depending on the specified comfort requirements or the requirements for the second transverse rigidity, by any fraction of its second height H2.

As can further be seen from FIG. 2, the second spring device 104.2 comprises at half its height a separation layer in the form of a metal disk 104.15 vulcanised into place, the diameter of which is selected in such a way that at the outer circumference of the second spring device 104.2, at half the height, a ring-shaped first stop surface 104.16 is formed. With an adequately large transverse deflection of the second spring device 104.2 in the transverse direction T, this first stop surface 104.16 comes in contact with a second stop surface 104.17 allocated to it, which is formed at the connection element 104.3. If this is the case, the lower section 104.18 of the second spring device 104.2, located beneath the metal disk 104.15, can no longer follow the transverse deflection. A further transverse deflection can then only be provided by the upper section 104.19 of the second spring device 104.2 still located above the metal disk 104.15. This further transverse deflection will be ended at the latest when the inner surface of the contact element 104.12 comes in contact with the connection element 104.3.

Due to the reduced height available after the two contact surfaces 104.16, 104.17 have come in contact, an abrupt rise occurs in the second transverse rigidity of the second spring device 104.2. Jointly with this, therefore, by way of this pair of contact surfaces formed from the two contact surfaces 104.16, 104.17, a progressive characteristic of the transverse rigidity of the second spring device 104.2 is achieved. This can be of advantage in particular from the point of view of travel dynamics, as well as from the point of view of comfort.

It is understood in this situation that, with other variants of the invention, with regard to the height of the second spring device, provision can also be made for another number of such contact surface pairs, in order to change the characteristics of the transverse rigidity of the second spring device in several steps. In this situation, provision can be made in particular for the individual height sections themselves to have a different transverse rigidity by way of a corresponding selection of their geometry and/or their dimensions and/or their material (individually or in sections), in order to achieve the desired characteristic of the transverse rigidity.

Second Embodiment

Referring to FIG. 3, a second preferred embodiment of the spring arrangement according to the invention is described hereinafter, in the form of a secondary spring step 204, which can be used instead of the secondary spring step 104 with the vehicle 101 from FIG. 1. FIG. 3 shows the secondary spring step 204 in this situation in a diagrammatical view similar to FIG. 2.

The secondary spring step 204 largely corresponds in its basic design and function to the secondary spring step 104 from FIG. 2, such that in this situation reference is made largely to the remarks made heretofore and only the differences will be considered. In particular, identical or similar components are provided with reference numbers increased by the value 100.

The only difference in relation to the secondary spring step 104 is that no separate connection element 104.3 is provided, but the connection element (described in detail heretofore in connection with the first embodiment) is designed as a part of the rubber leaf spring element 204.2, accordingly integrated into the second spring device 204.2. Accordingly, the second spring device 204.2, nested in the support direction S with the first spring device 204.1, itself provides corresponding connection surfaces for the first spring device 204.1. In particular, it provides a first support surface 204.8 for the first helical spring 204.4 of the first spring device 204.1.

In the example shown, adequate rigidity of the second spring device 204.2 is achieved in the connection area to the first spring device 204.1 by appropriate ring-shaped metal elements, which are vulcanised into the second spring device 204.2. It is understood, however, that with other variants such reinforcing metal elements can be done without, if appropriate.

Third Embodiment

Referring to FIG. 4, a third preferred embodiment of the spring arrangement according to the invention in the form of a secondary spring step 304 is described hereinafter, which can be used instead of the secondary spring step 104 with the vehicle 101 from FIG. 1. FIG. 3 shows the secondary spring step 304 in this situation in a diagrammatical view similar to FIG. 2.

The secondary spring step 304 largely corresponds in its basic design and function to the secondary spring step 104 from FIG. 2. However, while with the first embodiment the outer diameter of the second spring device 104.2 is smaller than the outer diameter of the first spring device 104.1 (with the second spring device 104.2 accordingly penetrating into the interior of the first spring device 104.1), with the secondary spring device 304 the outer diameter of the first spring device 304.1 is smaller than the outer diameter of the second spring device 304.2, such that the first spring device 304.1 projects into the interior of the second spring device 304.2.

As can be seen in detail from FIG. 4, the secondary spring step 304 in turn comprises a first spring device 304.1 supported on the bogie 103, as well as a second spring device 304.2 arranged mechanically in series with this, on which the body 103 is supported. The second spring device 304.2 is connected to the first spring device 304.1 by a connection element 304.3.

The first spring device 304.1 comprises a first helical spring 304.4 and a second helical spring 304.5 arranged mechanically parallel and concentric to it. The second spring device 304.2 is designed in the form of a ring-shaped rubber leaf spring, which is arranged concentrically to the first spring device 304.1.

The first spring device 304.1 comprises in a transverse direction T (in the xy plane in the position of rest shown), running transverse (perpendicular in the example shown) to the support direction S, a first transverse rigidity, which is greater than the second transverse rigidity which the rubber leaf spring 304.2 comprises in this transverse direction T. In the present example, the second transverse rigidity of the rubber leaf spring 304.2 amounts to some 50% of the first transverse rigidity of the first spring device 304.1. It is understood, however, that with other variants of the invention another proportion can be selected between the first transverse rigidity and the second transverse rigidity.

The two helical springs 304.4, 304.5 of the first spring device 304.1 are supported at their first end 304.6 on the bogie 102 (not represented in FIG. 4), while their second end 304.7 is supported against a first support surface 304.8 of the connection element 304.3. The rubber leaf spring 304.2 is in turn with its first end 304.9 supported on a second support surface 304.10 of the connection element 304.3, while the second end 304.11 of the rubber leaf spring 304.2 is supported, by a contact element 304.12 secured to it, at the body 103 (not represented in FIG. 4).

In addition to providing the connection between the first spring device 304.1 and the second spring device 304.2, the connection element 304.3 also undertakes the guidance of the two helical springs 304.4, 304.5 of the first spring device 304.1.

The connection element 304.3 is pot-shaped in design, wherein the pot is open towards the bogie 102. The first support surface 304.8 is designed as a floor support surface at an inner floor section 304.14 of the connection element 304.3, while the second support surface 304.10 is designed as an edge support surface at an outer edge section 304.13 of the connection element 304.3.

The first support surface 304.8 and the second support surface 304.10 point in opposite directions running parallel to the support direction S, and are separated in the support direction S from one another by a support surface interval D, such that the first support surface 304.8 in the support direction S is further away from the first end 304.6 of the first spring device 304.1 than the second support surface 304.10. Accordingly, the first spring device 304.1 and the second spring device 304.2 are arranged nested into each other in such a way that the first cover surface of the first spring device 304.1, defined by the first helical spring 304.4, and the second cover surface of the second spring device 304.2, defined by the rubber leaf spring 304.2, penetrate through or into one another in the support direction S.

The support surface interval D in this situation amounts to some 50% of the height (dimension in the support direction S) of the second spring device 304.2, such that the first cover surface of the first spring device 304.1 accordingly projects into 50% of the second cover surface of the second spring device 304.2. This nested arrangement of the first and second spring device 304.1, 304.2, arranged in mechanical series, has the advantage that, with a given overall height H of the springing components of the secondary spring step 304, despite a considerable first height H1 of the first spring device 304.1, a comparably great second height H2 of the second spring device 304.2 can be realised. The sum of the first height H1 and the second height H2 in this situation exceeds the overall height H (H1+H2>H).

This nesting arrangement according to the invention make it possible for the second height H2 of the second spring device to be adapted in such a way that the secondary spring step 304 comprises a transverse rigidity such as is required for specific predeterminable comfort requirements with regard to the introduction of acceleration forces in the transverse direction T into the body 103.

It is understood that the two spring devices in other variants of the invention can also penetrate into one another by an amount deviating from this. In particular, the second spring device can penetrate into the first spring device, within the limits specified by the overall height H, and depending on the specified comfort requirements or the requirements for the second transverse rigidity, by any desired fraction of its second height H2.

The design of the second spring device 304.2, located on the outside, in this situation has the particular advantage that, on the one hand, it can be easily subsequently fitted on already existing secondary spring steps, without intervention in the first spring device 304.1 being necessary. The variation in the second height H2 of the second spring device 304.2 can also be particularly easily put into effect, because in this case too no intervention in the design of the first spring device 304.1 is required.

As can be further seen from FIG. 4, the second spring device 304.2 in turn comprises at half its height a separation layer in the form of a metal disk 304.15 vulcanised into place, the diameter of which is selected in such a way that at the outer circumference of the second spring device 304.2, at half the height, a ring-shaped first stop surface 304.16 is formed. With an adequately large transverse deflection of the second spring device 304.2 in the transverse direction T, this first stop surface 304.16 comes into contact with a second stop surface 304.17 allocated to it, which is formed at the connection element 304.3. If this is the case, the lower section 304.18 of the second spring device 304.2, located beneath the metal disk 304.15, can no longer follow the transverse deflection. A further transverse deflection can then only be provided by the upper section 304.19 of the second spring device 304.2 still located above the metal disk 304.15. This further transverse deflection ends at the latest when the inner surface of the contact element 304.12 comes into contact with the connection element 304.3.

Due to the reduced height available after the two stop surfaces 304.16, 304.17 have come into contact, an abrupt rise occurs in the second transverse rigidity of the second spring device 304.2. Jointly with this, therefore, by way of this pair of contact surfaces formed from the two contact surfaces 304.16, 304.17, a progressive characteristic of the transverse rigidity of the second spring device 304.2 is achieved. This can be advantageous in particular from the point of view of travel dynamics, as well as from the point of view of comfort.

It is understood in this situation that, with other variants of the invention, with regard to the height of the second spring device, provision can also be made for another number of such contact surface pairs, in order to change the characteristics of the transverse rigidity of the second spring device in several steps. In this situation, provision can be made in particular for the individual height sections themselves to have a different transverse rigidity by way of a corresponding selection of their geometry and/or their dimensions and/or their material (individually or in sections), in order to achieve the desired characteristics of the transverse rigidity.

The present invention has been described heretofore exclusively on the basis of examples in which the second spring device is arranged at the end of the spring arrangement which faces the body. It is understood, however, that in other variants of the invention provision can also be made for such a second spring device to be located additionally or alternatively also at the end of the spring arrangement which faces the running gear. Likewise, it is of course also possible for provision to be made for the second spring device to be provided in the area between the two ends of the spring arrangement, wherein it is then preferably nested at both ends in the manner described with corresponding first spring devices.

The present invention has been described heretofore exclusively on the basis of examples of a light railway vehicle. It is understood, however, that the invention can also be applied in any other vehicles, in particular rail vehicles.

The invention claimed is:

1. A spring arrangement for a vehicle, comprising:

a first spring device;

a second spring device; and a stop device provided in a middle section of the second spring device, wherein the first spring device and the second spring device are mechanically arranged in series and are adapted to support a component of the vehicle on a further component of the vehicle in a support direction, the first spring device comprises a first transverse rigidity in a transverse direction running transverse to the support direction, the second spring device comprises a second transverse rigidity in the transverse direction, which is smaller than the first transverse rigidity, the first spring device and the second spring device are arranged so as to be nested in the support direction, and the stop device achieves a progressive characteristic of the second transverse rigidity by limiting a transverse deflection of a first part of the second spring device with respect to the first spring device and allowing transverse deflection of a second part of the second spring device with respect to the first spring device.

2. The spring arrangement according to claim 1, wherein the first spring device and the second spring device are connected to one another by at least one connection element.

3. The spring arrangement according to claim 2, wherein the connection element is designed in pot shape with an inner floor section and an outer edge section, wherein the floor section comprises a floor support surface, and the edge section comprises an edge support surface, the floor support surface and the edge support surface are spaced apart from one another in the support direction by one support surface interval and point in opposite directions running parallel to the support direction, and the first spring device is supported on the floor support surface and the second spring device on the edge support surface or the first spring device is supported on the edge support surface and the second spring device on the floor support surface.

4. The spring arrangement according to claim 2, wherein the first spring device comprises in the support direction a first end and a second end, the connection element comprises a first support surface for the second end of the first spring device and a second support surface for the second spring device, the first support surface and the second support surface are spaced apart from one another in the support direction by one support surface interval and point in opposite directions running parallel to the support direction, and the first support surface in the support direction is further away from the first end of the first spring device than the second support surface.

5. The spring arrangement according to claim 4, wherein the support surface interval amounts to at least 25% of a dimension of the second spring device in the support direction.

6. The spring arrangement according to claim 1, wherein the first spring device and the second spring device are connected to each other by at least one connection element, and the stop device comprises at least a first stop surface and a second stop surface provided to interact with the first stop surface, and the first stop surface is formed at the second spring device and the second stop surface is formed at the connection element.

7. The spring arrangement according to claim 6, wherein the second spring device is supported in the support direction with its first end on the connection element, and the first stop surface in the support direction is spaced at a distance of at least 20% of a dimension of the second spring device in the support direction from the first end of the second spring device.

8. The spring arrangement according to claim 1, wherein the first spring device comprises at least one spring element designed in the manner of a helical spring.

9. The spring arrangement according to claim 8, wherein the first spring device and the second spring device are connected to one another by at least one connection element, and the connection element forms at least a part of a transverse guide for the spring element.

10. The spring arrangement according to claim 1, wherein the second spring device comprises at least one synthetic material spring element.

11. The spring arrangement according to claim 10, wherein the second spring device is designed in the form of a leaf spring element with at least two synthetic material layers and a separation layer arranged between the two synthetic material layers.

12. The spring arrangement according to claim 11, wherein at least one stop device is provided, which is adapted to delimit a transverse deflection of at least a part of the second spring device in relation to the first spring device in the transverse direction, and the separation layer defines at least one stop surface of the stop device.

13. The spring arrangement according to claim 1, wherein the second transverse rigidity amounts to a maximum of 50% of the first transverse rigidity.

14. The spring arrangement according to claim 1, wherein the first spring device defines a first cover surface, the second spring device defines a second cover surface, and the first spring device and the second spring device are arranged nested in such a way that the first cover surface and the second cover surface in the support direction penetrate into one another in the support direction by at least 20% of a dimension of the second spring device in the support direction.

15. A vehicle with a first component and a second component, wherein the first component is supported on the second component by means of a spring arrangement according to claim 1.

16. The vehicle according to claim 15, wherein the first component is a body of the vehicle and the second component is at least a part of a running gear of the vehicle.

17. The vehicle according to claim 15, wherein it is designed as a light railway vehicle, which is designed at least in part in low-floor format.

* * * * *